US011927344B2

(12) United States Patent
Mayer

(10) Patent No.: US 11,927,344 B2
(45) Date of Patent: Mar. 12, 2024

(54) SYSTEM AND METHOD FOR WARMKEEPING SUB-CRITICAL STEAM GENERATOR

(71) Applicant: GENERAL ELECTRIC TECHNOLOGY GMBH, Baden (CH)

(72) Inventor: Ralph Mayer, Granby, CT (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 144 days.

(21) Appl. No.: 17/560,587

(22) Filed: Dec. 23, 2021

(65) Prior Publication Data

US 2023/0204206 A1 Jun. 29, 2023

(51) Int. Cl.
*F22D 1/28* (2006.01)
*F01K 7/34* (2006.01)
(Continued)

(52) U.S. Cl.
CPC ..... *F22D 1/28* (2013.01); *F22B 37/34* (2013.01); *F22D 1/325* (2013.01); *F22D 1/50* (2013.01);
(Continued)

(58) Field of Classification Search
CPC ... F22D 1/28; F22D 1/325; F22D 1/50; F22D 7/12
See application file for complete search history.

(56) References Cited

U.S. PATENT DOCUMENTS 44,851 A 11/1864 Champlin
192,036 A 6/1877 Vanosdol
(Continued)

FOREIGN PATENT DOCUMENTS

EP 0419839 4/1991
EP 0908603 4/1999
(Continued)

OTHER PUBLICATIONS

Beevers et al., "On the Prediction and Theory of the Temperature Increase of Low Pressure Last Stage Moving Blades During Low Volume Flow Condition, and Limiting it Through Steam Extraction Methods", Proceedings of ASME Turbo Expro 2014, Turbine Technical Conference and Exposition, GT 2014, Jun. 16 -20, 2014, Dusseldorf, Germany.

*Primary Examiner* — Laert Dounis
(74) *Attorney, Agent, or Firm* — Grogan, Tuccillo & Vanderleeden LLP

(57) ABSTRACT

A system and method for warmkeeping a steam generator such as a sub-critical steam generator is disclosed. Water extraction piping extracts water from a component of one of the water fill circuits of the sub-critical steam generator. A deaerator heating system having an inventory tank of water mixes the extracted water with the water in the tank, and heats the mix of water to a predetermined temperature level to generate heated deaerated feedwater. Feedwater piping forwards the heated deaerated feedwater at the predetermined temperature level from the deaerator heating system to the water fill circuits of the sub-critical steam generator. The water extraction piping, the deaerator heating system and the feedwater piping operate cooperatively to warmkeep the water fill circuits in accordance with the predetermined temperature level while the sub-critical steam generator is in the unfired stand-by mode of operation.

19 Claims, 4 Drawing Sheets

(51) Int. Cl.

| | |
|---|---|
| ***F01K 13/02*** | (2006.01) |
| ***F22B 37/34*** | (2006.01) |
| ***F22D 1/32*** | (2006.01) |
| ***F22D 1/50*** | (2006.01) |
| ***F22D 3/00*** | (2006.01) |
| ***F22D 7/12*** | (2006.01) |

(52) U.S. Cl.
CPC ..... *F22D 3/00* (2013.01); *F22D 7/12* (2013.01); *F01K 7/34* (2013.01); *F01K 13/02* (2013.01)

(56) References Cited

U.S. PATENT DOCUMENTS

| | | | | | |
|---|---|---|---|---|---|
| 3,163,009 | A | | 12/1964 | Rankin | |
| 3,954,087 | A | * | 5/1976 | Stevens | F22B 29/12 122/406.1 |
| 3,955,358 | A | * | 5/1976 | Martz | F01K 23/108 122/451 S |
| 4,048,012 | A | | 9/1977 | George et al. | |
| 4,554,889 | A | | 11/1985 | Lilly | |
| 4,911,107 | A | * | 3/1990 | Crispin | F22D 11/003 122/1 R |
| 5,029,443 | A | | 7/1991 | Hauser | |
| 5,042,246 | A | | 8/1991 | Moore et al. | |
| 5,396,865 | A | | 3/1995 | Freeh | |
| 5,412,936 | A | | 5/1995 | Lee et al. | |
| 5,687,674 | A | | 11/1997 | Johanntgen et al. | |
| 5,762,031 | A | * | 6/1998 | Gurevich | F22B 29/04 122/1 C |
| 6,851,266 | B2 | | 2/2005 | Liebig | |
| 7,107,774 | B2 | | 9/2006 | Radovich | |
| 8,276,382 | B2 | | 10/2012 | Hu et al. | |
| 8,573,196 | B2 | | 11/2013 | Plotkin et al. | |
| 8,776,521 | B2 | | 7/2014 | Tong et al. | |
| 8,820,078 | B1 | | 9/2014 | Duffy | |
| 9,228,452 | B2 | | 1/2016 | Terdalkar et al. | |
| 9,347,685 | B2 | | 5/2016 | Plotkin et al. | |
| 9,803,504 | B2 | | 10/2017 | Park | |
| 10,968,784 | B2 | | 4/2021 | Yan et al. | |
| 11,022,005 | B2 | | 6/2021 | Levin | |
| 11,125,118 | B1 | | 9/2021 | Mambro et al. | |
| 2010/0236240 | A1 | | 9/2010 | Hu et al. | |
| 2012/0031395 | A1 | | 2/2012 | Plotkin et al. | |
| 2013/0044851 | A1 | | 2/2013 | Winters et al. | |
| 2014/0007614 | A1 | | 1/2014 | Thacker et al. | |
| 2015/0113988 | A1 | | 4/2015 | Ichinose et al. | |
| 2015/0192036 | A1 | | 7/2015 | Sharp et al. | |
| 2016/0115869 | A1 | | 4/2016 | Migl et al. | |
| 2017/0058702 | A1 | | 3/2017 | Park | |
| 2021/0285335 | A1 | * | 9/2021 | Mambro | F01K 13/02 |

FOREIGN PATENT DOCUMENTS

| | | | | |
|---|---|---|---|---|
| EP | 0931978 | A1 | * | 7/1999 |
| GB | 1382342 | | | 1/1975 |
| JP | H10300013 | A | * | 11/1998 |
| JP | 2009293871 | A | * | 12/2009 |
| JP | 5183305 | | | 4/2013 |

* cited by examiner

SYSTEM AND METHOD FOR WARMKEEPING SUB-CRITICAL STEAM GENERATOR

BACKGROUND

Technical Field

Embodiments of this disclosure relate generally to steam generators for steam power plants, and more specifically, to a system and method for warmkeeping a steam generator such as a sub-critical steam generator.

Discussion of Art

A steam generator such as a sub-critical steam generator typically includes a furnace in which fuel is burned to create thermal energy or heat. The thermal energy or heat is used to heat and vaporize water in waterwall tubes to steam that line the furnace. The generated steam can be used in a steam turbine to drive a generator to produce electricity or provide heat for other purposes.

For a utility operating such a system, the time from a cold, unfired mode of operation to a firing mode of operation in which steam and ultimately electricity is generated, is a major commercial factor in generating revenues. Many efforts are done to shorten the time that it takes to transition from the unfired mode of operation to the firing mode of operation in order to be more responsive to market demands.

Currently, a typical start-up time for a cold start-up of a sub-critical steam generator that is in a cold stand-by mode in an unfired state to the firing mode is somewhere between 12 hours to 20 hours before reaching nominal electricity production. The limitations to shorten the time that it takes to transition from the unfired stand-by mode to the firing mode are the masses of metal which need to be heated up within safe temperature rise criteria to minimize thermal stress on components containing these masses of metal. The gradients of the safe temperature rise criteria are material grade dependent, and the rate of change in temperature is also influenced by the operating pressure that the tubing/piping of the components is exposed to. Generally, the rate of change of temperature in a low pressure region is more limiting than at elevated pressures for components of a sub-critical steam generator (e.g., a boiler drum).

BRIEF DESCRIPTION

The following presents a simplified summary of the disclosed subject matter in order to provide a basic understanding of some aspects of the various embodiments described herein. This summary is not an extensive overview of the various embodiments. It is not intended to exclusively identify key features or essential features of the claimed subject matter set forth in the Claims, nor is it intended as an aid in determining the scope of the claimed subject matter. Its sole purpose is to present some concepts of the disclosure in a streamlined form as a prelude to the more detailed description that is presented later.

The various embodiments of the present invention are directed to reducing the overall "return to service" time of a sub-critical steam generator transitioning from an unfired stand-by mode of operation to a firing mode of operation. The solution provided by the various embodiments includes elevating and maintaining the condition of the sub-critical steam generator while in the stand-by mode of operation to a more favorable start-up condition that brings about a faster reaction by the sub-critical steam generator to return to service in a firing mode of operation without delay. The more favorable start-up condition corresponds to an "all-the-time readiness" state that allows the sub-critical steam generator to transition from pre-operational readying of the generator prior to light-off (i.e., filling of water fill circuits) to readying the generator for light-off (i.e., igniting a fire to further heating of the water, and engage in steam production) without delay. This transition between pre-operational readiness and light-off that occurs without delay prevents a temperature decay in the water fill circuits and metal temperature of the components of the circuits. As a result, the need to reheat these components which is often the case when there is a delay to proceed with a return to service is eliminated, and thus, time and expenses can be reduced for the utility.

The various embodiments attain the more favorable start-up condition by maintaining the pre-warmed condition of the feedwater in the sub-critical steam generator. In particular, water that has been provided to components of the fill circuits such as the boiler drum and furnace waterwall tubes by the feedwater emanating from a deaerator heating system are extracted from these components, recirculated to the deaerator heating system, pre-heated, and fed back into the sub-critical steam generator to components such as the economizer and/or the furnace waterwall tubes.

Since the sub-critical steam generator is still in an unfired condition while in the stand-by mode of operation, a water temperature of near boiling point can be achieved. This can elevate the water temperature and the metal temperature of the components of the water fill circuits to a predetermined elevated temperature (e.g., almost 200° F.). The resulting increase in tube/pipe metal temperature of the components reduces tube/pipe stress associated with thermal shock when the sub-critical steam generator is lit off. This enables the sub-critical steam generator to reach allowable ramp rates in a shorter time due to already elevated temperatures and greater equilibrium between media and metal surface(s).

In accordance with one embodiment, a system for warmkeeping a plurality of water fill circuits of a sub-critical steam generator at an elevated temperature while in an unfired stand-by mode of operation is provided. The system comprises: water extraction piping to extract water from a component of one of the plurality of water fill circuits; a deaerator heating system to provide heated deaerated feedwater to the plurality of water fill circuits, the deaerator heating system having an inventory tank of water that is in fluid communication with the water extraction piping to receive the extracted water from the component, the extracted water from the component mixing with the water in the inventory tank, wherein the deaerator heating system heats the mix of water in the inventory tank to a predetermined temperature level to generate heated deaerated feedwater; and feedwater piping that forwards the heated deaerated feedwater at the predetermined temperature level from the deaerator heating system to the plurality of water fill circuits of the steam generator, wherein the water extraction piping, the deaerator heating system and the feedwater piping operate cooperatively to warmkeep the plurality of water fill circuits in accordance with the predetermined temperature level by recirculating the extracted water and the heated deaerated feedwater through the plurality of circuits while the steam generator is in the unfired stand-by mode of operation.

In accordance with another embodiment, a system for warmkeeping components of a plurality of water fill circuits of a sub-critical steam generator including an economizer, furnace waterwall tubes, a boiler drum, and at least one boiler drum downcomer while the sub-critical steam generator is in an unfired stand-by mode of operation is provided. The system comprises: water extraction piping to extract water from one or more of the furnace waterwall tubes and the at least one boiler drum downcomer; a deaerator heating system to provide heated deaerated feedwater to the plurality of water fill circuits from an inventory tank; a forwarding pump operatively coupled to the water extraction piping and the deaerator heating system to forward the extracted water to the inventory tank for mixing with the water in the inventory tank, wherein the deaerator heating system heats the mix of water in the inventory tank to a predetermined temperature level to generate the heated deaerated feedwater; feedwater piping that supplies the heated deaerated feedwater at the predetermined temperature level from the deaerator heating system towards the sub-critical steam generator; and a feedwater pump operatively coupled to the feedwater piping and the deaerator heating system to forward the heated deaerated feedwater to the sub-critical steam generator, the heated deaerated feedwater filling the water fill circuits associated with the economizer, the furnace waterwall tubes, the boiler drum, and the at least one boiler drum downcomer; wherein the water extraction piping, the forwarding pump, the deaerator heating system, the feedwater piping and the feedwater pump operate cooperatively to warmkeep the plurality of water fill circuits in accordance with the predetermined temperature level by recirculating the extracted water and the heated deaerated feedwater through the plurality of circuits while the sub-critical steam generator is in the unfired stand-by mode of operation.

In accordance with third embodiment, a method for warmkeeping a plurality of water fill circuits of a sub-critical steam generator at an elevated temperature while the sub-critical steam generator is in an unfired stand-by mode of operation is provided. The method comprises: extracting water from a component of one of the plurality of water fill circuits; forwarding the extracted water to a deaerator heating system having an inventory tank of water; mixing the extracted water with the water in the inventory tank; heating the mix of water in the inventory tank to a predetermined temperature level to form heated deaerated feedwater; supplying the heated deaerated feedwater at the predetermined temperature level to the plurality of water fill circuits of the steam generator; and warmkeeping the plurality of water fill circuits in accordance with the predetermined temperature level while the steam generator is in the unfired stand-by mode of operation by continuously recirculating the heated deaerated feedwater and the extracted water to and from the steam generator until the steam generator returns to service in a firing mode of operation.

DRAWINGS

The present invention will be better understood from reading the following description of non-limiting embodiments, with reference to the attached drawings, wherein below:

Figure 2:
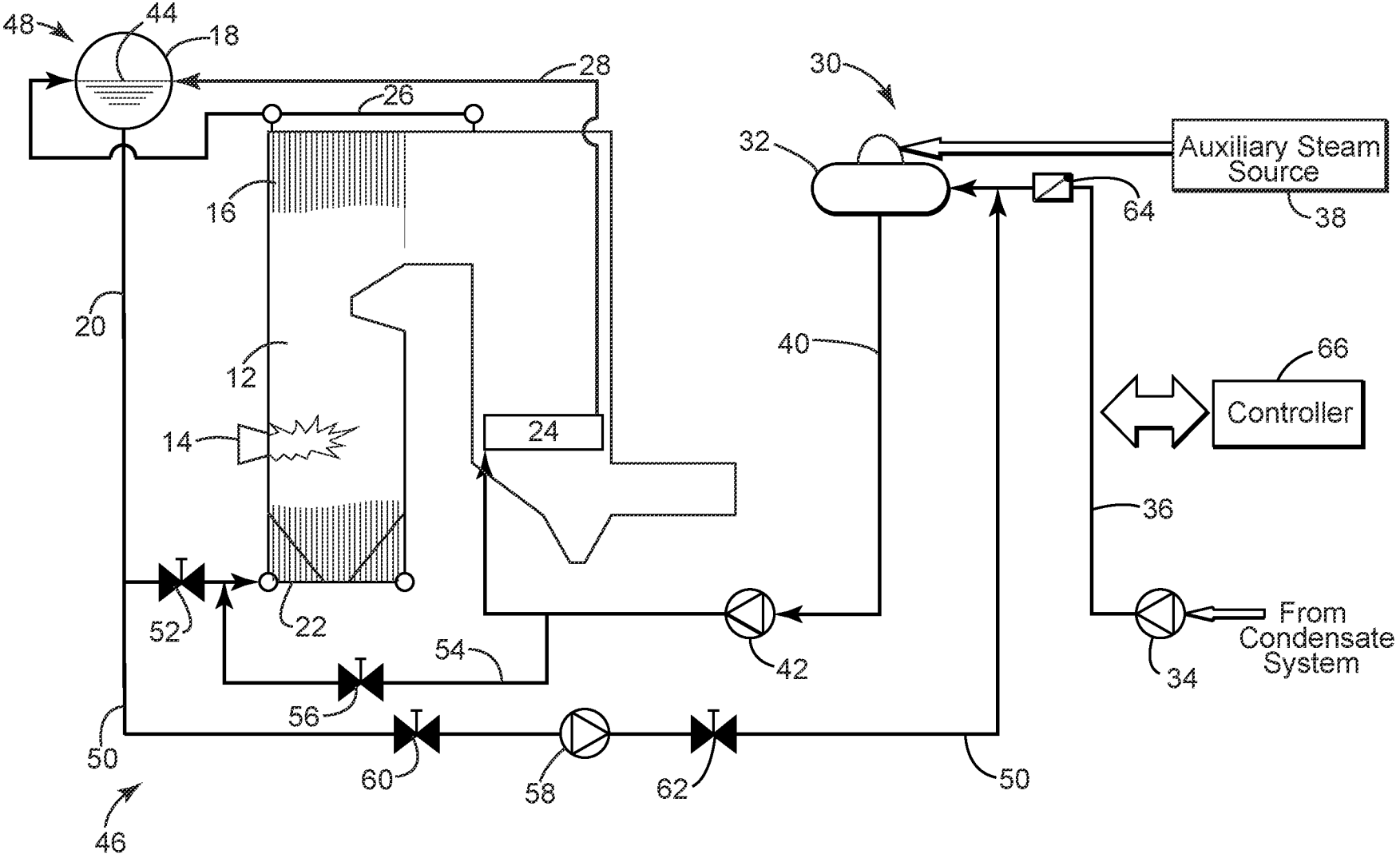
FIG. 2 shows a schematic of a system for warmkeeping a plurality of water fill circuits of a sub-critical steam generator at an elevated temperature while in an unfired stand-by mode of operation according to an embodiment of the invention.
Figure 3:
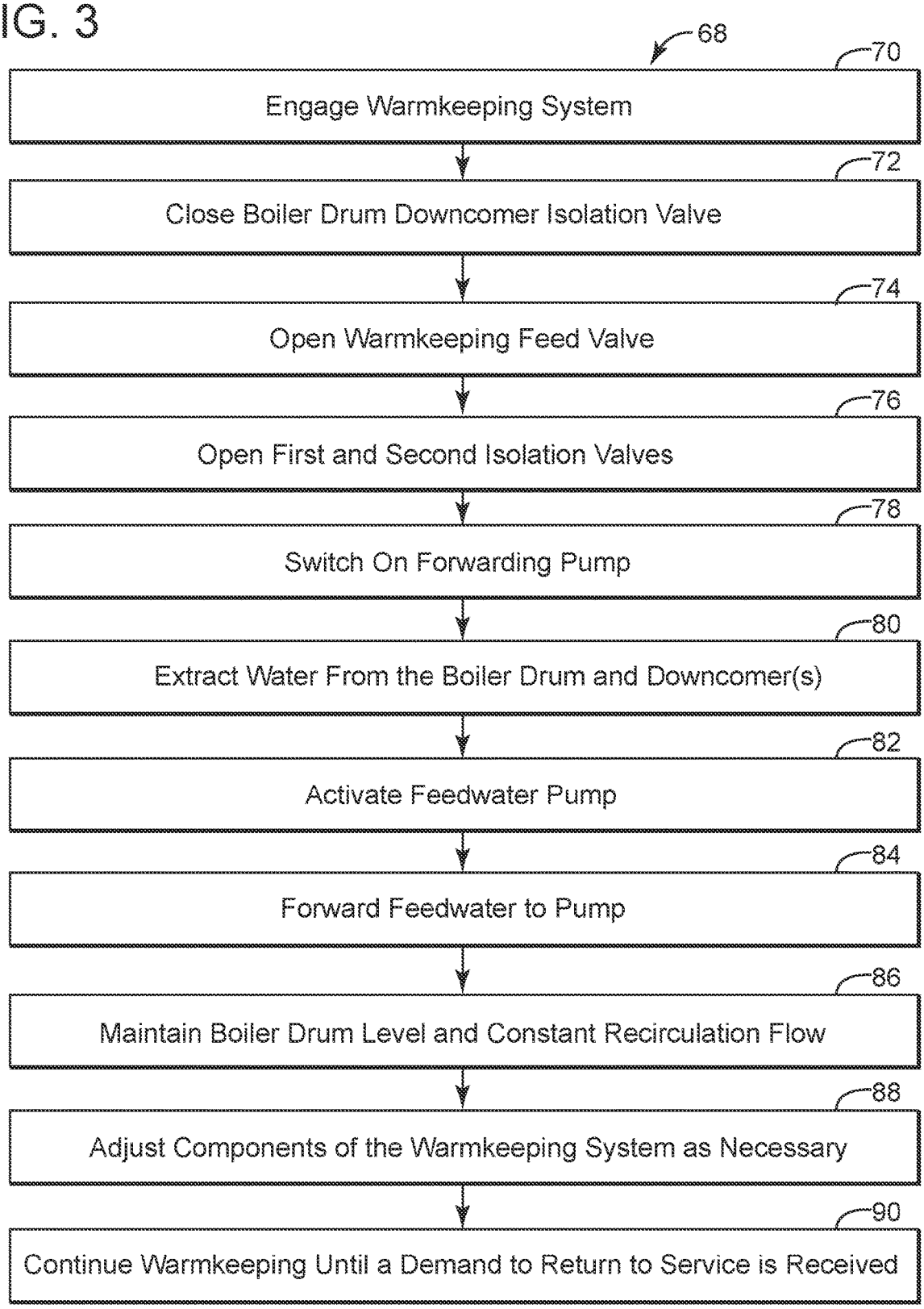
Figure 4:
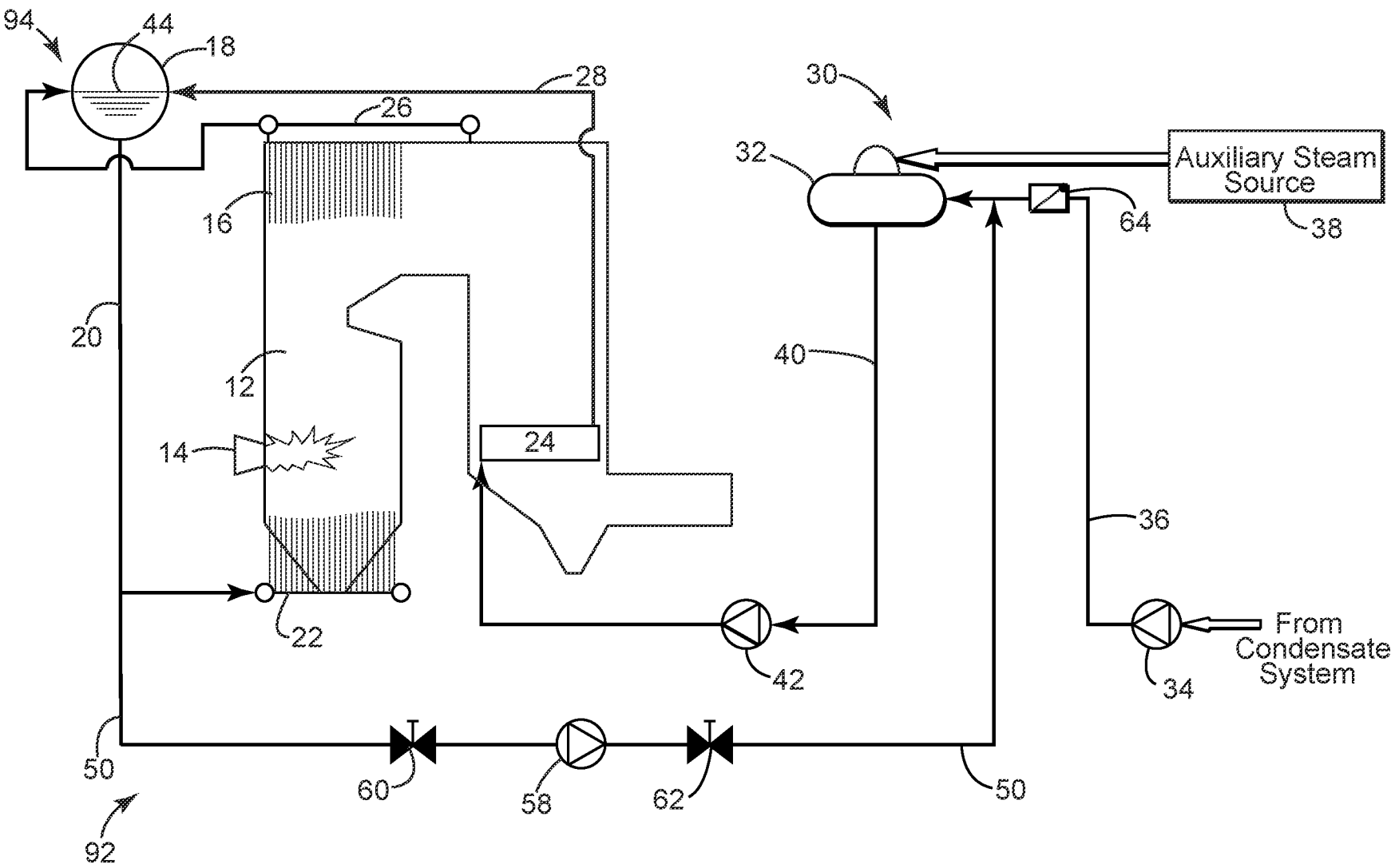

FIG. 3 shows a flow chart describing the warmkeeping operations associated with the system depicted in FIG. 2 according to an embodiment of the invention; and FIG. 4 shows a schematic of a system for warmkeeping a plurality of water fill circuits of a sub-critical steam generator at an elevated temperature while in an unfired stand-by mode of operation according to another embodiment of the invention.

DETAILED DESCRIPTION

Example embodiments of the present invention will be described more fully hereinafter with reference to the accompanying drawings, in which some, but not all embodiments are shown. Indeed, the present invention may be embodied in many different forms and should not be construed as limited to the embodiments set forth herein; rather, these embodiments are provided so that this disclosure will satisfy applicable legal requirements. For like numbers may refer to like elements throughout.

This disclosure relates generally to the warmkeeping of a sub-critical steam generator that is in a stand-by mode of operation in which the generator is not firing. Although the disclosure is described with respect to a sub-critical steam generator, it is understood that the warmkeeping system and method of the various embodiments is applicable to other types of steam generators. As used herein, warmkeeping of a steam generator such as a sub-critical steam generator means increasing and maintaining warmth of the components of the steam generator at an elevated temperature while in the stand-by mode of operation in an unfired condition. To this extent, warmkeeping the sub-critical steam generator according to the various embodiments described herein places the steam generator in a more favorable start-up condition that equates to an "all-the-time readiness" state that allows the sub-critical steam generator to transition from the stand-by mode of operation to the firing mode of operation without delay, and thus, more responsive to sudden electrical grid demands.

In the various embodiments, warmkeeping of the sub-critical steam generator is attained by making use of an existing heating circuit that includes a deaerator heating system, to increase and maintain components of the water fill circuits of the sub-critical steam generator that can include an economizer, a boiler drum, a boiler drum downcomer(s), furnace waterwall tubes (an evaporator), at an elevated temperature level while the steam generator is in an unfired state in the stand-by mode of operation. In particular, warmkeeping of the sub-critical steam generator per the various embodiments described herein includes extracting water from one or more of the boiler drum downcomer(s) and the furnace waterwall tubes, and recirculating the extracted water to the deaerator heating system, which pre-heats the water to a predetermined elevated temperature level, and feeds it back to the economizer, the boiler drum, the boiler drum downcomer(s) and the furnace waterwall tubes using a feedwater pump circuit that operates in conjunction with the deaerator heating system. By continuously recirculating the heated water and the extracted water to and from the sub-critical steam generator while in the stand-by mode, the components of the steam generator are maintained at the elevated temperature, and thus, the sub-critical steam generator is placed in a more favorable start-up condition that enables a faster start-up time and return to service as the steam generator transitions from the unfired stand-by mode of operation to the firing mode of operation.

Figure 1:
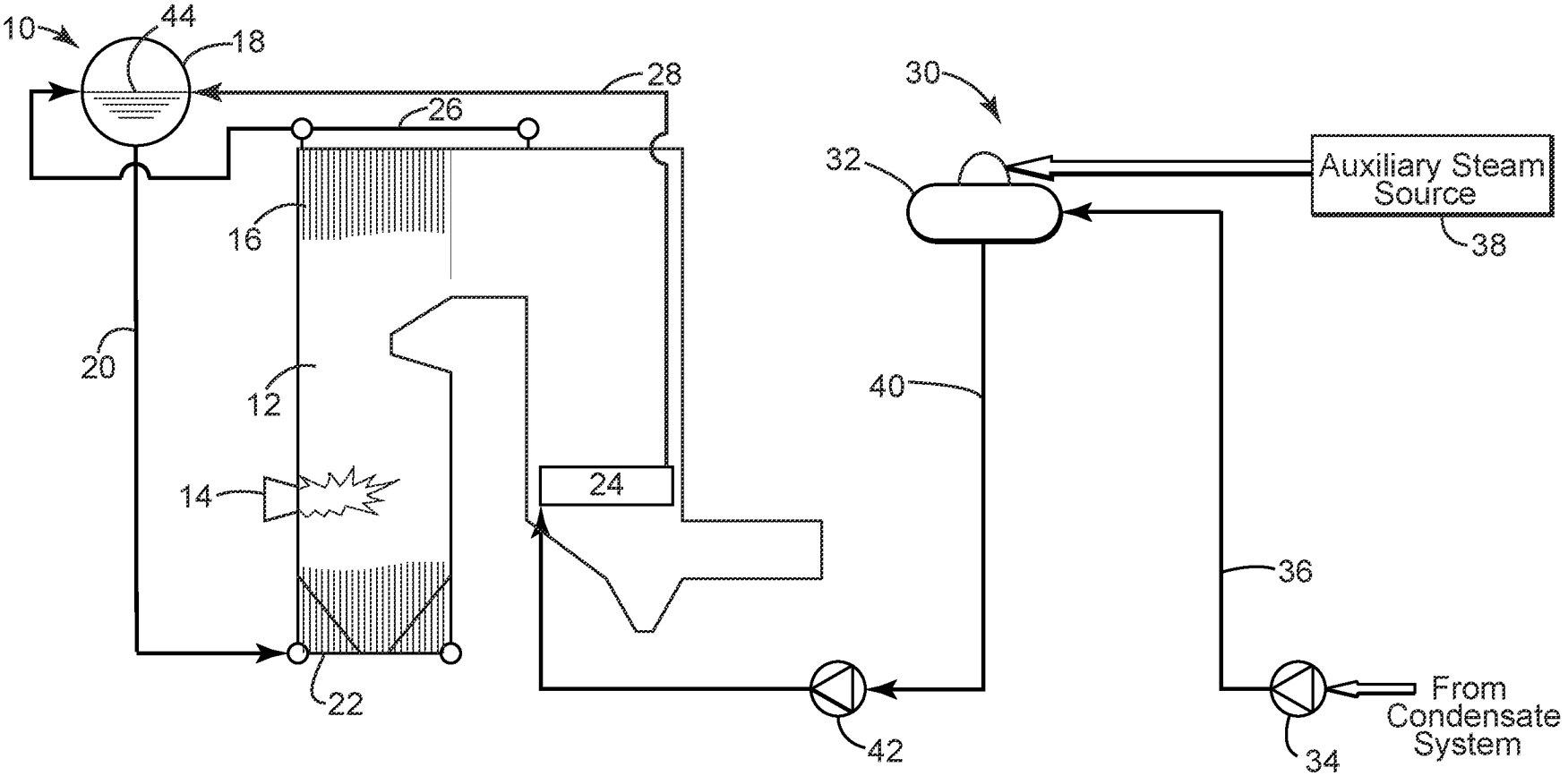
FIG. 1 PRIOR ART
FIG. 1 shows a schematic of a sub-critical steam generator according to the prior art.

Turning now to the figures, FIG. 1 shows a schematic of a sub-critical steam generator 10 according to the prior art that produces steam that can be used for power generation or heating purposes. As shown in FIG. 1, the sub-critical steam generator 10 includes a furnace 12 that burns a mixture 14 of fuel and air provided to the furnace. The fuel, which can be a pulverized solid fuel, such as coal, is provided to the furnace by a pulverizer (not shown). While pulverized coal is mainly used as fuel, the furnace 12 can be designed to enable mixed combustion of oil, biomass or a by-product gas. The air can be provided to the furnace 12 via an air source (not shown). The mixture 14 of fuel and air burns in the combustion chamber of the furnace 12. The combustion of the fuel and air creates thermal energy or heat, which is used to heat and vaporize a liquid, such as water, in furnace waterwall tubes 16 that line the walls of the furnace 12, of which these tubes can also be referred to as the evaporator part of the furnace. The heating and vaporizing of the water in the furnace waterwall tubes 16 creates steam. The steam generated in the sub-critical steam generator 10 may be made to flow to a turbine (not shown) to generate electricity or provide heat for other purposes.

Other components of the sub-critical steam generator 10 include a boiler drum 18, one or more boiler drum downcomers 20, an inlet header or headers 22 to the furnace waterwall tubes 16, and an economizer 24. The boiler drum 18 is a reservoir of water/steam at the top-end of the furnace waterwall tubes 16. In addition to receiving a steam mixture from the top end of the furnace waterwall tubes 16 via furnace top-end piping 26, the boiler drum 18 can receive water from feedwater supplied to the economizer 24 via economizer outlet feedwater piping 28. The feedwater supplied to the economizer 24 comes from a deaerator heating system 30 that includes an inventory tank 32 of water obtained from a condensate system via a condensate pump 34 and condensate piping 36, an auxiliary steam source 38 to heat the tank, and feedwater piping 40 that supplies heated deaerated feedwater to the economizer 24 via a feedwater pump 42. It is understood that the sub-critical steam generator 10 can have other components that are not discussed herein for purposes of clarity.

The furnace waterwall tubes 16, the boiler drum 18, the one or more boiler drum downcomers 20, the inlet header 22, the economizer 24, the furnace top-end piping 26, the economizer outlet feedwater piping 28, the feedwater piping 40, the feedwater pump 42, as well as the deaerator heating system 30 and the components of the condensate system (e.g., the condensate pump 34 and the condensate piping 36) are components that can form parts of the various water fill circuits of the sub-critical steam generator 10. In these water fill circuits, water comes into the boiler drum 18 from the economizer 24 and the economizer outlet feedwater piping 28. The water that comes into the boiler drum 18 will go to the inlet header 22 for supply to the furnace waterwall tubes 16 at the bottom end of the furnace 12. The water entering the bottom of the furnace 12 at the furnace waterwall tubes 16 raises upwards along the tubewalls. The combustion of the mixture 14 of fuel and air heats and vaporizes the water in the furnace waterwall tubes 16 into steam. The boiler drum 18 receives the steam from the furnace waterwall tubes 16 through the furnace top end piping 26 and will separate the saturated steam from the water and steam mixture in the drum. In this manner, the sub-critical steam generator 10 can provide the saturated steam to other parts in the steam generator for further heating and ultimately to a steam turbine to generate electricity or provide heat for other purposes, while the steam free water is mixed with the replenishing incoming feedwater from the economizer outlet feedwater piping 28 in the boiler drum 18 and through natural circulation through boiler drum downcomer(s) 20 and furnace waterwall tubes 16 within the furnace 12 fed back to the boiler drum 18 for further steam generation.

As noted above, sub-critical steam generators, like sub-critical steam generator 10, are slow to transition from an unfired stand-by mode of operation to a firing mode of operation upon a demand to return to service. For example, readying the sub-critical steam generator 10 starts with filling the economizer 24, the furnace waterwall tubes 16, and the boiler drum 18 with pre-cycle cleaned water that comes from the deaerator heating system 30 and the condensate system. Although not shown in FIG. 1, the condensate system can include a condenser that cools exhaust steam from a turbine, collects the latent heat of the steam, and condenses the steam into water. The condensate pump 34 can pressurize the condensed water for supply to the deaerator heating system 30 via the condensate piping 36.

The inventory tank 32 of the deaerator heating system 30 can receive the condensed water from the condensate piping 36. The inventory tank 32 can include a feedwater storage tank with a connected deaerator tank. In general, the purpose of this tank combination that can form the inventory tank 32 is to store and deaerate through pre-warming the water inventory before it is fed to the economizer 24 of the sub-critical steam generator 10. Pre-warming the water in the inventory tank 32 is accomplished by the auxiliary steam source 38, which can be an external heat source. This pre-warming of the water in the inventory tank 32 can occur while the sub-critical steam generator 10 is not in service.

This pre-warmed or pre-heated water is then forwarded from the deaerator heating system 30 as heated deaerated feedwater into the tube bank section of the economizer 24 of the sub-critical steam generator 10 via the feedwater piping 40 and the feedwater pump 42. The feedwater passes through the economizer 24 to fill the boiler drum 18 via the economizer outlet feedwater piping 28. As the water reaches the boiler drum 18, the boiler drum downcomer(s) 20 will fill up as well. This builds a fill connection to the furnace waterwall tubes 16 via the inlet header 22. As more water is fed through the economizer 24, the furnace waterwall tubes 16 will fill to the roof level or top-end of the furnace 12. This allows the boiler drum level to rise to a start-up level that is near or slightly below a boiler drum centerline 44.

At this time the pre-operational filling part of the readying process of the sub-critical steam generator 10 is complete. The pre-operational filling part can take anywhere from one (1) to four (4) hours, occasionally even more. With the pre-operational filling part complete, the readying process of the sub-critical steam generator 10 can continue with the light-off, which entails igniting a fire in the furnace 12 to further heating the water and to engage in the steam production.

If the sub-critical steam generator 10 is subject to a delay to proceed with a return to service in the firing mode as the steam generator needs to go through the pre-operational filling part of the readying process of the sub-critical steam generator, a temperature decay arises in the water fill and metal temperatures of the water fill components. Consequently, lacking the elevated component temperatures that occurs through the pre-operational filling, a transition from the stand-by mode of operation to the firing mode of operation can impact design lifecycle and operational margins of these components. The resulting increase in tube metal temperature can lead to tube stress associated with thermal shock when the sub-critical steam generator 10 is lit off. This exacerbates the time and expenses that utilities incur because of the delay in proceeding to service from the stand-by mode of operation to the firing mode of operation and during the initial firing mode operation.

In order to obviate these issues, the emphasis of the warmkeeping system of the various embodiments is in the pre-operational filling part of the readying process of the sub-critical steam generator, i.e., the filling of the water-fill circuits to ready the steam generator for light-off. The various embodiments can attain a more favorable start-up condition by maintaining the pre-warmed condition of the feedwater in the sub-critical steam generator. Since the sub-critical steam generator is still in an unfired condition while in the stand-by mode of operation, a water temperature of near boiling point can be achieved (e.g., almost 200° F.). This can elevate the water temperature and the metal temperature of the components of the water fill circuits to the desired near boiling point temperature. The resulting increase in the tube/pipe metal temperature of the components reduces tube/pipe stress associated with thermal shock when the sub-critical steam generator is lit off. This enables the sub-critical steam generator to reach allowable ramp rates in a shorter time due to already elevated temperatures and greater equilibrium between media and metal surface(s).

To this extent, warmkeeping the sub-critical steam generator according to the various embodiments places the steam generator in an "all-the-time readiness" state that allows the sub-critical steam generator to transition from the stand-by mode of operation to the firing mode of operation without delay. The capability to have this "all-the-time readiness" state present in a sub-critical steam generator at every moment while in the stand-by mode is desirable for utilities that deploy these stand-by utility production units in order to react to a return to service demand without delay as any further delay between pre-operational readiness and light-off will have a temperature decay in the water fill and metal temperature of the filled components.

FIG. 2 shows a schematic of a system 46 for warmkeeping components of a plurality of water fill circuits of a sub-critical steam generator 48 at an elevated temperature while in an unfired stand-by mode of operation according to an embodiment of the invention. As shown in FIG. 2, the warmkeeping system 46 can include water extraction piping 50 to extract water from the boiler drum downcomer(s) 20. A boiler drum downcomer isolation valve 52 can isolate the boiler drum downcomer(s) 20 from the inlet header 22 to the furnace waterwall tubes 16. To this extent, the boiler drum downcomer isolation valve 52 is operative to control the flow of water from the boiler drum downcomer 20 to the water extraction piping 50.

Although the boiler drum downcomer is illustrated in the figures as a single downcomer, it is understood that the boiler drum downcomer can include one or a multiple of boiler drum downcomers (i.e., at least one boiler drum downcomer) connected to the boiler drum 18. Accordingly, the warmkeeping system 46 of FIG. 2 can include at least one boiler drum downcomer isolation valve 52 to correspondingly isolate a boiler drum downcomer 20 from the inlet header 22 to the furnace waterwall tubes 16. In general, the purpose of the at least one boiler drum downcomer isolation valve 52 is to separate the otherwise existing short circuit between the boiler drum downcomer(s) 20 and the furnace waterwall tubes 16 to allow a withdrawal of water from the boiler drum 18, and a distinct feedback of the re-heated water from the deaerator heating system 30 into the waterwall tubes 16 via warmkeeping piping 54 and a warmkeeping feed valve 56.

The warmkeeping system 46 of FIG. 2 can further include a forwarding pump 58 operatively coupled to the water extraction piping 50 and the deaerator heating system 30 to forward the extracted water from the boiler drum downcomer(s) 20 to the inventory tank 32 for mixing with the water in the inventory tank. In this manner, the deaerator heating system 30 can heat the mix of water in the inventory tank 32 to a predetermined temperature level to generate the heated deaerated feedwater. In one embodiment, the forwarding pump 58 can include a low pressure forwarding pump that assists in the extraction of boiler water from the boiler drum 18 that is present in the boiler drum downcomer(s) 20 in sufficient quantity to support the maintaining of the elevated heat in the furnace waterwall tubes 16. In addition, the low pressure forwarding pump can also overcome any system pressure losses.

A first isolation valve 60 and a second isolation valve 62 can isolate the forwarding pump 58 when it is not in service, which occurs when the sub-critical steam generator 48 is lit off. In particular, the forwarding pump 58 will be a low pressure application as the warmkeeping system 46 shall only be in service when the sub-critical steam generator 48 is not fired and at atmospheric pressure. Once lit off, the pressure of the boiler drum 18 will start to rise and natural circulation in the furnace waterwall tubes 16 will start, making the recirculation provided by the service of the warmkeeping system 46 not needed anymore. The forwarding pump 58 should then be isolated.

As shown in FIG. 2, the first isolation valve 60 can be in fluid communication with the boiler drum downcomer(s) 20 and the forwarding pump 58 via the water extraction piping 50, while the second isolation valve 62 can be in fluid communication with the inventory tank 32 and the forwarding pump 58 via the water extraction piping 50. As used herein, the term "in fluid communication" means that there is a passage that allows a fluid to flow. In general, the first isolation valve 60 can act as a pump isolation valve, while the second isolation valve 62 can act as forward isolation valve. To this extent, the first isolation valve 60 and the second isolation valve 62 can isolate the forwarding pump 50 from operating in response to the sub-critical steam generator 48 transitioning from the unfired stand-by mode of operation to the firing mode of operation.

In one embodiment as shown in FIG. 2, a condensate non-return valve 64 can be deployed between the deaerator heating system 30 and the condensate system. For example, the condensate non-return valve 64 can be in fluid communication with the inventory tank 32 and the condensate pump 34 via the condensate piping 36. In this manner, the condensate non-return valve 64 can be operative to control a flow of the condensate in the condensate piping 36 between the condensate pump 34 and the inventory tank 32. As a result, the condensate non-return valve 64 can allow the warmkeeping recirculation line that is provided by the water extraction piping 50 to be connected to the inventory tank 32. It is understood that the condensate non-return valve 64 can be an optional component that depends on the piping configuration from the condensate system. For example, the condensate non-return valve 64 may not be necessary if there is a condensate pump discharge isolation valve downstream of the condensate pump 34. If there is no condensate pump discharge isolation valve downstream of the condensate pump 34, then the condensate non-return valve 64 can be installed and tied in with the condensate piping 36 and the inventory tank 32. To this extent, no additional nozzle has to be installed at the inventory tank 32. As used herein, "downstream" and "upstream" are terms that indicate a direction relative to the flow of a fluid.

As noted above, the warmkeeping system 46 includes warmkeeping piping 54 and a warmkeeping feed valve 56 that provides a distinct feedback of the re-heated water (i.e., the heated deaerated feedwater) from the deaerator heating deaerator heating system 30 into the furnace waterwall tubes 16. FIG. 2 shows that the warmkeeping piping 54 can be in fluid communication with the feedwater piping 40 to divert a portion of the heated deaerated feedwater in the feedwater piping that is directed to the economizer 24 for supply to the furnace waterwall tubes 16 via the inlet header 22. In one embodiment, the warmkeeping feed valve 56 can be operative to control an amount of the heated deaerated feedwater that is diverted from the feedwater piping 40 for supply to the furnace waterwall tubes 16 and an amount of the heated deaerated feedwater that is supplied to the economizer 24. In this manner, the warmkeeping feed valve 56 can be utilized to proportion the amount of re-heated water (i.e., the heated deaerated feedwater) from the deaerator heating system 30 that enters the economizer 24 via the feedwater piping 40 and the amount that enters the furnace waterwall tubes 16 via the warmkeeping piping 54 and the inlet header 22, for maximum benefit and to overcome flow distribution problems.

The warmkeeping system 46 of FIG. 2 can also include a controller 66 operatively coupled with the water extraction piping 50, the boiler drum downcomer isolation valve 52, the first isolation valve 60, the forwarding pump 58, the second isolation valve 62, the deaerator heating system 30, the condensate pump 34, the condensate piping 36, the feedwater piping 40, the feedwater pump 42, the warmkeeping piping 54, and the warmkeeping feed valve 56 to control the warmkeeping of the components of the plurality of water fill circuits of the sub-critical steam generator 48. In one embodiment, the controller 66 is configured to control operation of these components, which can be electrically controllable devices, to recirculate the heated deaerated feedwater from the deaerator heating system 30 to the water fill circuits and the extracted water from the sub-critical steam generator (e.g., the boiler drum downcomer(s) 20) to the deaerated heating system. As explained below with reference to FIG. 3, the controller 66 can coordinate operation of the aforementioned components to maintain constant recirculation flow of the heated deaerated feedwater and the extracted water. The controller 66 can also be further configured to adjust the recirculation flow of the heated deaerated feedwater and the extracted water to maintain the temperature of the water fill circuits with the predetermined temperature level that is set by the deaerator heating system 30.

It is understood that the warmkeeping system 46 can include a number of other components not depicted in FIG. 2. For example, the warmkeeping system 46 can include one or more sensors disposed about the sub-critical steam generator 48 to detect any of a number of conditions. To this extent, the sensors can be in communication with the controller 66 to provide measurements representative of any number of parameters that the sensors are configured to detect. In one embodiment, one or more temperature sensors can be disposed about the sub-critical steam generator 48 to obtain temperature measurements about the warmkeeping system 46 as well as the steam generator. For example, temperature sensors can be located about one or more of the boiler drum 18, the boiler drum downcomer(s) 20, the inlet header 22, the economizer 24, the furnace top-end piping 26, the economizer feedwater piping 28, the deaerator heating system 30 (e.g., the inventory tank 32), the feedwater piping 40, the water extraction piping 50, and the warmkeeping piping 54. In this manner, the controller 66 can monitor the temperature of the heated deaerated water, the extracted water, as well as the temperature of some of the components of the water fill circuits of the steam generator in order to ensure that the warmkeeping system 46 is maintaining the components at an elevated temperature level that corresponds with a predetermined temperature level for placing the sub-critical steam generator 48 in the "all-the-time readiness" state or more favorable start-up condition while in the unfired stand-by mode of operation.

In addition to temperature sensors, it is understood that the warmkeeping system 46 can deploy other types of sensors. For example, a non-limiting list of sensors that may be suitable for use with the warmkeeping system 46 and the sub-critical steam generator 48 can include pressure sensors, flow sensors, and humidity sensors.

In order to implement some of the controlling features provided by the warmkeeping system 46, the controller 66 may include the necessary electronics, software, memory, storage, databases, firmware, logic/state machines, microprocessors, communication links, displays or other visual or audio user interfaces, printing devices, and any other input/output interfaces to perform the functions described herein and/or to achieve the results described herein, which may be accomplished in real-time. For example, the controller 66 depicted in FIG. 2 may include at least one processor and system memory/data storage structures, which may include random access memory (RAM) and read-only memory (ROM). The at least one processor of the controller 66 may include one or more conventional microprocessors and one or more supplementary co-processors such as math co-processors or the like. The data storage structures may include an appropriate combination of magnetic, optical and/or semiconductor memory, and may include, for example, RAM, ROM, flash drive, an optical disc such as a compact disc and/or a hard disk or drive.

Additionally, a software application that adapts the controller 66 to carry out the operations disclosed herein may be read into a main memory of the at least one processor from a computer-readable medium. The term "computer-readable medium," as used herein, refers to any medium that provides or participates in providing instructions to the at least one processor of the controller 66 (or any other processor of a device described herein) for execution. Such a medium may take many forms, including but not limited to, non-volatile media and volatile media. Non-volatile media include, for example, optical, magnetic, or opto-magnetic disks, such as memory. Volatile media include dynamic random-access memory (DRAM), which typically constitutes the main memory. Common forms of computer-readable media include, for example, a floppy disk, a flexible disk, hard disk, magnetic tape, any other magnetic medium, a CD-ROM, DVD, any other optical medium, a RAM, a PROM, an EPROM or EEPROM (electronically erasable programmable read-only memory), a FLASH-EEPROM, any other memory chip or cartridge, or any other medium from which a computer can read.

While in embodiments, the execution of sequences of instructions in the software application causes at least one processor to perform the methods/processes described herein, hard-wired circuitry may be used in place of, or in combination with, software instructions for implementation of the methods/processes of the present invention. Therefore, embodiments of the present invention are not limited to any specific combination of hardware and/or software.

FIG. 3 shows a flow chart 68 describing warmkeeping operations associated with the warmkeeping system 46 depicted in FIG. 2 according to an embodiment of the invention. As shown in FIG. 3, the flow chart 68 starts at 70 where the warmkeeping system 46 is engaged to maintain the sub-critical steam generator 48 in the "all-the-time readiness" state. In general, the warmkeeping system 46 can be engaged once the sub-critical steam generator 48 has been filled to readiness for start-up and an indefinite delay has been received. Once the warmkeeping system 46 is engaged, the boiler drum downcomer isolation valve 52 is closed at 72. Under normal operation of the sub-critical steam generator 48, the boiler drum downcomer isolation valve 52 is always fully open.

Once it is confirmed that the boiler drum downcomer isolation valve 52 is closed, the warmkeeping feed valve 56 shall be fully opened at 74. With the condensate pump 34 being either out of service and isolated or in "leak-off" mode through either the condensate non-return valve 64 or a condensate pump discharge isolation valve, the first isolation valve 60 upstream of the forwarding pump 58 and the second isolation valve 62 downstream of the forwarding pump 58 can be open at 76. The forwarding pump 58 can then be switched on at 78. With the forwarding pump 58 switched on, the water extraction piping 50 can extract water from the boiler drum 18 via the boiler drum downcomer(s) 20 at 80.

The water level of the inventory tank 32 will shortly increase as water is extracted from the boiler drum 18 and the boiler drum downcomer(s) 20. The decrease in boiler drum level as water is extracted from the boiler drum 18 and the boiler drum downcomer(s) 20 will activate the feedwater pump 42 at 82. The feedwater pump 42 can then forward feedwater to the furnace 12 at 84 so that the desired start-up level of the boiler drum 18 can be reestablished. In this manner, the water fill circuits of the sub-critical steam generator 48 can balance out.

The controller 66 can coordinate the operation of the forwarding pump 58 and the feedwater pump 42 to maintain the boiler drum level and a constant recirculation flow of the heated deaerated feedwater and the extracted water at 86. To this extent, the water extraction piping 50, the forwarding pump 58, the deaerator heating system 30, the feedwater piping 40 and the feedwater pump 42 can operate cooperatively to warmkeep the plurality of water fill circuits in accordance with the a desired predetermined temperature level by recirculating the extracted water and the heated deaerated feedwater through the plurality of circuits while the sub-critical steam generator 46 is in the unfired stand-by mode of operation.

The flow chart 68 of FIG. 3 shows that components of the warmkeeping system 46 can be adjusted at 88 to generate a flow balance or imbalance in order to maintain a desired temperature level in the sub-critical steam generator 48. For example, by throttling back on the warmkeeping feed valve 56, a flow balance or imbalance can be created to maintain a desired temperature in either section of the economizer 24 (economizer tube bundles) and the furnace waterwall tubes 16. During this adjusting, the auxiliary steam source 38 can maintain the water temperature of the water in the inventory tank 32 at a desired predetermined temperature level. In one embodiment, the predetermined temperature level can correspond to a near boiling condition that can range from about 190° F. to about 211° F., with about 200° F. being a preferable temperature level. With this configuration, the auxiliary steam source 38 can be configured to make up for the temperature loss in the sub-critical steam generator 48 to the surrounding atmosphere in order to produce the maximum possible elevated temperature in the furnace waterwall tubes 16 and/or economizer 24. Any rise of water level in the inventory tank 32 due to the introduction of heating steam from the auxiliary steam source 38 can be drained off to the auxiliary steam source 38 or discharged.

The warmkeeping of the sub-critical steam generator 48 that is provided by the warmkeeping system 46 continues until there is a demand for a return to service in the firing mode as noted at 90. Once the demand for a return to service in the firing mode is received, then the warmkeeping system 46 is shut off and the sub-critical steam generator 48 can undergo light-off.

While for purposes of simplicity of explanation, the operations shown in FIG. 3 are described as a series of acts. It is to be understood and appreciated that the subject innovation associated with FIG. 3 is not limited by the order of acts, as some acts may, in accordance therewith, occur in a different order and/or concurrently with other acts from that shown and described herein. For example, those skilled in the art will understand and appreciate that a methodology or operations depicted in FIG. 3 could alternatively be represented as a series of interrelated states or events, such as in a state diagram. Moreover, not all illustrated acts may be required to implement a methodology in accordance with the innovation. Furthermore, interaction diagram(s) may represent methodologies, or methods, in accordance with the subject disclosure when disparate entities enact disparate portions of the methodologies. Further yet, two or more of the disclosed example methods can be implemented in combination with each other, to accomplish one or more features or advantages described herein.

FIG. 4 shows a schematic of a system 92 for warmkeeping a plurality of water fill circuits of a sub-critical steam generator 94 at an elevated temperature while in an unfired stand-by mode of operation according to another embodiment of the invention. The warmkeeping system 92 of FIG. 4 differs from the warmkeeping system 46 of FIG. 2 in that the boiler drum downcomer isolation valve 52, the warmkeeping piping 54, and the warmkeeping feed valve 56 are omitted, as can the controller 66. With these components removed, the warmkeeping system 92 can extract water from water from the boiler drum downcomer(s) 20 or from water in the inlet header 22.

As shown in FIG. 4, the water extraction piping 50 can extract water from the boiler drum downcomer(s) 20 or water in the inlet header 22. In this manner, the extracted water from the boiler drum downcomer(s) 20 or the inlet header 22 can be forwarded to the deaerator heating system 30 via the forwarding pump 58 and used for reheating the water in the inventory tank 32. The extraction is "uncontrolled" as the specific pressure drops in the furnace waterwall tubes 16 and the boiler drum downcomer(s) 20 determine the flow taken out of each of these water fill circuits. That is, specific pressure drops in the boiler drum downcomer(s) 20 or the inlet header 22 will determine an amount of water that is extracted by the water extraction piping 50 and forwarded to the inventory tank 32 by the forwarding pump 58.

In one embodiment, the water extraction piping 50, the forwarding pump 58, the deaerator heating system 30 and the feedwater piping 40 can operate to recirculate the heated deaerated feedwater from the deaerator heating system 30 to the plurality of water fill circuits of the sub-critical generator 94 and the extracted water from the boiler drum downcomer(s) 20 or the inlet header 22 to the deaerator heating system 30. To this extent, the warmkeeping system 92 will self-regulate any deviation of temperature imbalance of the plurality of water fill circuits from the predetermined temperature level associated with the heated deaerated feedwater.

Accordingly, with this warmkeeping recirculation configuration, any temperature imbalance created will be self-regulating over time and an equilibrium in both the waterwall tubes 16 and the economizer 24 will result. The process of this warmkeeping recirculation configuration of the warmkeeping system 92 will take longer than the warmkeeping recirculation configuration of the warmkeeping system 46 of FIG. 2 which entails a "controlled" extraction, but the result will be ultimately the same.

From the description of the illustrated embodiments presented herein, it should be evident that the subject disclosure sets forth an effective solution for warmkeeping a steam generator such as a sub-critical steam generator while in an unfired stand-by mode of operation. The warmkeeping solution provided by the various embodiments entails elevating the water temperature and the metal temperature of the components of the water fill circuits with heated deaerated feedwater, extracting the water from the sub-critical steam generator that has been pre-warmed by the feedwater, and recirculating the heated deaerated feedwater and the extracted water to maintain the elevated temperature while the steam generator is in the unfired stand-by mode of operation.

The warmkeeping recirculation system of the various embodiments creates a more favorable start-up condition that allows the sub-critical steam generator to react faster to a demand to return to service in a firing mode of operation without delay. In addition, with the warmkeeping recirculation system of the various embodiments, a temperature decay in the water fill circuits and metal temperature of the components of the circuits is obviated because the components of the water fill circuits that typically experience the highest thermal stresses do not in these embodiments because the warmkeeping recirculation system maintains the temperature of these components at the elevated temperature during the stand-by mode of operation. Thus, the thermal shocks that can lead to tube stress and adverse impact on the design lifecycle and tolerances of these components that is associated with delays in transitioning from an unfired stand-by mode of operation to a firing mode of operation is avoided with the warmkeeping recirculation system of the various embodiments.

Other benefits associated with the warmkeeping recirculation system of the various embodiments in addition to a reduced return to service time, less thermal stress to components of the water fill circuits (e.g., furnace waterwall tubes/the evaporator and boiler drum) can include reduced fuel consumption and reduced emissions by the sub-critical steam generator, and utilization of existing installed power plant equipment and system already in service.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize. For example, parts, components, steps and aspects from different embodiments may be combined or suitable for use in other embodiments even though not described in the disclosure or depicted in the figures. Therefore, since certain changes may be made in the above-described invention, without departing from the spirit and scope of the invention herein involved, it is intended that all of the subject matter of the above description shown in the accompanying drawings shall be interpreted merely as examples illustrating the inventive concept herein and shall not be construed as limiting the invention.

In this regard, while the disclosed subject matter has been described in connection with various embodiments and corresponding figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below. For example, references to "one embodiment" of the present invention are not intended to be interpreted as excluding the existence of additional embodiments that also incorporate the recited features.

In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. The terms "substantially," "generally," and "about" indicate conditions within reasonably achievable manufacturing and assembly tolerances, relative to ideal desired conditions suitable for achieving the functional purpose of a component or assembly. Further, the limitations of the following claims are not written in means-plus-function format and are not intended to be interpreted as such, unless and until such claim limitations expressly use the phrase "means for" followed by a statement of function void of further structure.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

What has been described above includes examples of systems and methods illustrative of the disclosed subject matter. It is, of course, not possible to describe every combination of components or methodologies here. One of ordinary skill in the art may recognize that many further combinations and permutations of the claimed subject matter are possible. Furthermore, to the extent that the terms "includes," "has," "possesses," and the like are used in the detailed description, claims, appendices and drawings, such terms are intended to be inclusive in a manner similar to the term "comprising" as "comprising" is interpreted when employed as a transitional word in a claim. That is, unless explicitly stated to the contrary, embodiments "comprising," "including," or "having" an element or a plurality of elements having a particular property may include additional such elements not having that property.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

Further aspects of the invention are provided by the subject matter of the following clauses:

A system for warmkeeping a plurality of water fill circuits of a steam generator at an elevated temperature while in an unfired stand-by mode of operation, comprising: water extraction piping to extract water from a component of one of the plurality of water fill circuits; a deaerator heating system to provide heated deaerated feedwater to the plurality of water fill circuits, the deaerator heating system having an inventory tank of water that is in fluid communication with the water extraction piping to receive the extracted water from the component, the extracted water from the component mixing with the water in the inventory tank, wherein the deaerator heating system heats the mix of water in the inventory tank to a predetermined temperature level to generate heated deaerated feedwater; and feedwater piping that forwards the heated deaerated feedwater at the predetermined temperature level from the deaerator heating system to the plurality of water fill circuits of the steam generator, wherein the water extraction piping, the deaerator heating system and the feedwater piping operate cooperatively to warmkeep the plurality of water fill circuits in accordance with the predetermined temperature level by recirculating the extracted water and the heated deaerated feedwater through the plurality of circuits while the steam generator is in the unfired stand-by mode of operation.

The system of the preceding clause, further comprising a forwarding pump operatively coupled to the water extraction piping to forward the extracted water to the inventory tank.

The system of any of the preceding clauses, further comprising a first isolation valve and a second isolation valve, with each isolation valve operatively coupled with the water extraction piping and the forwarding pump, wherein the first isolation valve is in fluid communication with the component and the forwarding pump, and the second isolation valve is in fluid communication with the inventory tank and the forwarding pump.

The system of any of the preceding clauses, further comprising a feedwater pump operatively coupled to the feedwater piping to forward the heated deaerated feedwater to components of the plurality of water fill circuits of the steam generator.

The system of any of the preceding clauses, wherein the water extraction piping, the forwarding pump, the deaerator heating system and the feedwater piping operate to recirculate the heated deaerated feedwater from the deaerator heating system to the plurality of water fill circuits and the extracted water from the component to the deaerator heating system, self-regulating any deviation of temperature imbalance of the plurality of water fill circuits from the predetermined temperature level associated with the heated deaerated feedwater.

The system of any of the preceding clauses, further comprising a controller operatively coupled with the water extraction piping, the deaerator heating system, and the feedwater piping to control the warmkeeping of the plurality of water fill circuits, wherein the controller is configured to control operation of the water extraction piping, the deaerator heating system and the feedwater piping to recirculate the heated deaerated feedwater from the deaerator heating system to the plurality of water fill circuits and the extracted water from the component to the deaerator heating system, wherein the controller coordinates operation of flow of the water through the water extraction piping, the deaerator heating system and the feedwater piping to maintain constant recirculation flow of the heated deaerated feedwater and the extracted water.

The system of any of the preceding clauses, wherein the controller is configured to adjust the recirculation flow of the heated deaerated feedwater and the extracted water to maintain the temperature of the plurality of water fill circuits with the predetermined temperature level.

The system of any of the preceding clauses, wherein the controller is configured to continue adjusting the recirculation flow of the heated deaerated feedwater and the extracted water and maintaining the temperature of the plurality of water fill circuits to correspond with the predetermined temperature level while the steam generator is in the unfired stand-by mode of operation, the controller stopping the adjusting of the recirculation flow and maintaining of the temperature in response to the steam generator returning to service in a firing mode of operation.

A system for warmkeeping components of a plurality of water fill circuits of a sub-critical steam generator including an economizer, furnace waterwall tubes, a boiler drum, and at least one boiler drum downcomer while the sub-critical steam generator is in an unfired stand-by mode of operation, the system comprising: water extraction piping to extract water from one or more of the furnace waterwall tubes and the at least one boiler drum downcomer; a deaerator heating system to provide heated deaerated feedwater to the plurality of water fill circuits from an inventory tank; a forwarding pump operatively coupled to the water extraction piping and the deaerator heating system to forward the extracted water to the inventory tank for mixing with the water in the inventory tank, wherein the deaerator heating system heats the mix of water in the inventory tank to a predetermined temperature level to generate the heated deaerated feedwater; feedwater piping that supplies the heated deaerated feedwater at the predetermined temperature level from the deaerator heating system towards the sub-critical steam generator; and a feedwater pump operatively coupled to the feedwater piping and the deaerator heating system to forward the heated deaerated feedwater to the sub-critical steam generator, the heated deaerated feedwater filling the water fill circuits associated with the economizer, the furnace waterwall tubes, the boiler drum, and the at least one boiler drum downcomer; wherein the water extraction piping, the forwarding pump, the deaerator heating system, the feedwater piping and the feedwater pump operate cooperatively to warmkeep the plurality of water fill circuits in accordance with the predetermined temperature level by recirculating the extracted water and the heated deaerated feedwater through the plurality of circuits while the sub-critical steam generator is in the unfired stand-by mode of operation.

The system of the preceding clause, further comprising a first isolation valve and a second isolation valve, wherein the first isolation valve is in fluid communication with the one or more of the furnace waterwall tubes and the at least one boiler drum downcomer, and the forwarding pump, and the second isolation valve is in fluid communication with the inventory tank and the forwarding pump.

The system of any of the preceding clauses, wherein the first isolation valve and the second isolation valve isolate the forwarding pump from operating in response to the sub-critical steam generator transitioning from the unfired stand-by mode of operation to a firing mode of operation.

The system of any of the preceding clauses, wherein the water extraction piping extracts water from at least one boiler drum downcomer that provides water from the boiler drum to an inlet header to the furnace waterwall tubes.

The system of any of the preceding clauses, further comprising at least one boiler drum downcomer isolation valve to correspondingly isolate the at least one boiler drum downcomer from the inlet header, wherein the at least boiler drum downcomer isolation valve is operative to control the flow of water from the at least one boiler drum downcomer to the water extraction piping.

The system of any of the preceding clauses, further comprising warmkeeping piping in fluid communication with the feedwater piping to divert a portion of the heated deaerated feedwater in the feedwater piping that is directed to the economizer for supply to the furnace waterwall tubes.

The system of any of the preceding clauses, further comprising a warmkeeping feed valve operative to control an amount of the heated deaerated feedwater that is diverted from the feedwater piping for supply to the furnace waterwall tubes and an amount of the heated deaerated feedwater for supply to the economizer.

The system of any of the preceding clauses, further comprising a controller operatively coupled with the water extraction piping, the forwarding pump, the deaerator heating system, the feedwater piping and the feedwater pump to control the warmkeeping of the components of the plurality of water fill circuits, wherein the controller is configured to control operation of the water extraction piping, the forwarding pump, the deaerator heating system, the feedwater piping, and the feedwater pump to recirculate the heated deaerated feedwater from the deaerator heating system to the plurality of water fill circuits and the extracted water from the sub-critical steam generator to the deaerator heating system, wherein the controller coordinates operation of the water extraction piping, the forwarding pump, the deaerator heating system, the feedwater piping, and the feedwater pump to maintain constant recirculation flow of the heated deaerated feedwater and the extracted water.

The system of any of the preceding clauses, wherein the controller is configured to adjust the recirculation flow of the heated deaerated feedwater and the extracted water to maintain the temperature of the plurality of water fill circuits with the predetermined temperature level.

The system of any of the preceding clauses, wherein the water extraction piping extracts water from the at least one boiler downcomer that provides water from the boiler drum to an inlet header to the furnace waterwall tubes or from water in the inlet header, wherein specific pressure drops in the at least one boiler downcomer or the inlet header-determine an amount of water that is extracted by the water extraction piping and forwarded to the inventory tank by the forwarding pump.

The system of any of the preceding clauses, wherein the water extraction piping, the forwarding pump, the deaerator heating system and the feedwater piping operate to recirculate the heated deaerated feedwater from the deaerator heating system to the plurality of water fill circuits and the extracted water from the at least one boiler downcomer or the inlet header of the furnace waterwall tubes to the deaerator heating system, self-regulating any deviation of temperature imbalance of the plurality of water fill circuits from the predetermined temperature level associated with the heated deaerated feedwater.

A method for warmkeeping a plurality of water fill circuits of a steam generator at an elevated temperature while the generator is in an unfired stand-by mode of operation, the method comprising: extracting water from a component of one of the plurality of water fill circuits; forwarding the extracted water to a deaerator heating system having an inventory tank of water; mixing the extracted water with the water in the inventory tank; heating the mix of water in the inventory tank to a predetermined temperature level to form heated deaerated feedwater; supplying the heated deaerated feedwater at the predetermined temperature level to the plurality of water fill circuits of the steam generator; and warmkeeping the plurality of water fill circuits in accordance with the predetermined temperature level while the steam generator is in the unfired stand-by mode of operation by continuously recirculating the heated deaerated feedwater and the extracted water to and from the steam generator until the steam generator returns to service in a firing mode of operation.

What is claimed is:

1. A system for warm keeping a plurality of water fill circuits of a steam generator including an economizer, furnace waterwall tubes, a boiler drum, and at least one boiler drum downcomer that provides water from the boiler drum to an inlet header to the furnace waterwall tubes, at an elevated temperature while in an unfired stand-by mode of operation, the system comprising:

water extraction piping to extract water from a component of one of the plurality of water fill circuits, the component including the at least one boiler drum downcomer that provides water from the boiler drum to the inlet header to the furnace waterwall tubes, the water extraction piping branching from the at least one boiler drum downcomer;

a deaerator heating system to provide heated deaerated feedwater to the plurality of water fill circuits, the deaerator heating system having an inventory tank of water that is in fluid communication with the water extraction piping to receive the extracted water from the component, the extracted water from the component mixing with the water in the inventory tank, wherein the deaerator heating system heats the mix of water in the inventory tank to a predetermined temperature level to generate heated deaerated feedwater;

feedwater piping that forwards the heated deaerated feedwater at the predetermined temperature level from the deaerator heating system to the plurality of water fill circuits of the steam generator; and a controller configured to control the water extraction piping, the deaerator heating system and the feedwater piping to operate cooperatively to warmkeep the plurality of water fill circuits in accordance with the predetermined temperature level by recirculating the extracted water and the heated deaerated feedwater through the plurality of water fill circuits while the steam generator is in the unfired stand-by mode of operation.

2. The system according to claim 1, further comprising a forwarding pump operatively coupled to the water extraction piping to forward the extracted water to the inventory tank.

3. The system according to claim 2, further comprising a first isolation valve and a second isolation valve, with each isolation valve operatively coupled with the water extraction piping and the forwarding pump, wherein the first isolation valve is in fluid communication with the component and the forwarding pump, and the second isolation valve is in fluid communication with the inventory tank and the forwarding pump.

4. The system according to claim 2, further comprising a feedwater pump operatively coupled to the feedwater piping to forward the heated deaerated feedwater to components of the plurality of water fill circuits of the steam generator.

5. The system according to claim 4, wherein the water extraction piping, the forwarding pump, the deaerator heating system and the feedwater piping operate to recirculate the heated deaerated feedwater from the deaerator heating system to the plurality of water fill circuits and the extracted water from the component to the deaerator heating system, self-regulating any deviation of temperature imbalance of the plurality of water fill circuits from the predetermined temperature level associated with the heated deaerated feedwater.

6. The system according to claim 1, further comprising the controller operatively coupled with the water extraction piping, the deaerator heating system, and the feedwater piping to control the warm keeping of the plurality of water fill circuits, wherein the controller is configured to control operation of the water extraction piping, the deaerator heating system and the feedwater piping to recirculate the heated deaerated feedwater from the deaerator heating system to the plurality of water fill circuits and the extracted water from the component to the deaerator heating system, wherein the controller coordinates operation of flow of the water through the water extraction piping, the deaerator heating system and the feedwater piping to maintain constant recirculation flow of the heated deaerated feedwater and the extracted water.

7. The system according to claim 6, wherein the controller is configured to adjust the recirculation flow of the heated deaerated feedwater and the extracted water to maintain the temperature of the plurality of water fill circuits with the predetermined temperature level.

8. The system according to claim 7, wherein the controller is configured to continue adjusting the recirculation flow of the heated deaerated feedwater and the extracted water and maintaining the temperature of the plurality of water fill circuits to correspond with the predetermined temperature level while the steam generator is in the unfired stand-by mode of operation, the controller stopping the adjusting of the recirculation flow and maintaining of the temperature in response to the steam generator returning to service in a firing mode of operation.

9. A system for warm keeping components of a plurality of water fill circuits of a sub-critical steam generator including an economizer, furnace waterwall tubes, a boiler drum, and at least one boiler drum downcomer that provides water from the boiler drum to an inlet header to the furnace waterwall tubes, while the sub-critical steam generator is in an unfired stand-by mode of operation, the system comprising:

water extraction piping to extract water from the at least one boiler drum downcomer that provides water from the boiler drum to the inlet header to the furnace waterwall tubes, the water extraction piping branching from the at least one boiler drum downcomer;

a deaerator heating system to provide heated deaerated feedwater to the plurality of water fill circuits from an inventory tank, wherein the deaerator heating system is configured to receive the extracted water from the water extraction piping;

a forwarding pump operatively coupled to the water extraction piping and the deaerator heating system to forward the extracted water to the inventory tank for mixing with the water in the inventory tank, wherein the deaerator heating system heats the mix of water in the inventory tank to a predetermined temperature level to generate the heated deaerated feedwater;

feedwater piping that supplies the heated deaerated feedwater at the predetermined temperature level from the deaerator heating system towards the sub-critical steam generator;

a feedwater pump operatively coupled to the feedwater piping and the deaerator heating system to forward the heated deaerated feedwater to the sub-critical steam generator, the heated deaerated feedwater filling the water fill circuits associated with the economizer, the furnace waterwall tubes, the boiler drum, and the at least one boiler drum downcomer; and a controller configured to control the water extraction piping, the forwarding pump, the deaerator heating system, the feedwater piping and the feedwater pump to operate cooperatively to warm keep the plurality of water fill circuits in accordance with the predetermined temperature level by recirculating the extracted water and the heated deaerated feedwater through the plurality of water fill circuits while the sub-critical steam generator is in the unfired stand-by mode of operation.

10. The system of claim 9, further comprising a first isolation valve and a second isolation valve, wherein the first isolation valve is in fluid communication with the one or more of the furnace waterwall tubes and the at least one boiler drum downcomer, and the forwarding pump, and the second isolation valve is in fluid communication with the inventory tank and the forwarding pump.

11. The system of claim 10, wherein the first isolation valve and the second isolation valve isolate the forwarding pump from operating in response to the sub-critical steam generator transitioning from the unfired stand-by mode of operation to a firing mode of operation.

12. The system of claim 9, further comprising at least one boiler drum downcomer isolation valve to correspondingly isolate the at least one boiler drum downcomer from the inlet header, wherein the at least boiler drum downcomer isolation valve is operative to control the flow of water from the at least one boiler drum downcomer to the water extraction piping.

13. The system of claim 9, further comprising warmkeeping piping in fluid communication with the feedwater piping to divert a portion of the heated deaerated feedwater in the feedwater piping that is directed to the economizer for supply to the furnace waterwall tubes.

14. The system of claim 13, further comprising a warmkeeping feed valve operative to control an amount of the heated deaerated feedwater that is diverted from the feedwater piping for supply to the furnace waterwall tubes and an amount of the heated deaerated feedwater for supply to the economizer.

15. The system according to claim 9, further comprising the controller operatively coupled with the water extraction piping, the forwarding pump, the deaerator heating system, the feedwater piping and the feedwater pump to control the warm keeping of the components of the plurality of water fill circuits, wherein the controller is configured to control operation of the water extraction piping, the forwarding pump, the deaerator heating system, the feedwater piping, and the feedwater pump to recirculate the heated deaerated feedwater from the deaerator heating system to the plurality of water fill circuits and the extracted water from the sub-critical steam generator to the deaerator heating system, wherein the controller coordinates operation of the water extraction piping, the forwarding pump, the deaerator heating system, the feedwater piping, and the feedwater pump to maintain constant recirculation flow of the heated deaerated feedwater and the extracted water.

16. The system according to claim 15, wherein the controller is configured to adjust the recirculation flow of the heated deaerated feedwater and the extracted water to maintain the temperature of the plurality of water fill circuits with the predetermined temperature level.

17. The system according to claim 9, wherein specific pressure drops in the at least one boiler downcomer or the inlet header-determine an amount of water that is extracted by the water extraction piping and forwarded to the inventory tank by the forwarding pump.

18. The system according to claim 17, wherein the water extraction piping, the forwarding pump, the deaerator heating system and the feedwater piping operate to recirculate the heated deaerated feedwater from the deaerator heating system to the plurality of water fill circuits and the extracted water to the deaerator heating system, self-regulating any deviation of temperature imbalance of the plurality of water fill circuits from the predetermined temperature level associated with the heated deaerated feedwater.

19. A method for warmkeeping a plurality of water fill circuits of a steam generator including an economizer, furnace waterwall tubes, a boiler drum, and at least one boiler drum downcomer that provides water from the boiler drum to an inlet header to the furnace waterwall tubes, at an elevated temperature while the generator is in an unfired stand-by mode of operation, the method comprising:

extracting water from a component of one of the plurality of water fill circuits with water extraction piping, the component including the at least one boiler drum downcomer that provides water from the boiler drum to the inlet header to the furnace waterwall tubes, the water extraction piping branching from the at least one boiler drum downcomer;

forwarding the extracted water from the component to a deaerator heating system having an inventory tank of water;

mixing the extracted water from the component with the water in the inventory tank;

heating the mix of water in the inventory tank to a predetermined temperature level to form heated deaerated feedwater;

supplying the heated deaerated feedwater at the predetermined temperature level to the plurality of water fill circuits of the steam generator; and warmkeeping the plurality of water fill circuits in accordance with the predetermined temperature level while the steam generator is in the unfired stand-by mode of operation by continuously recirculating the heated deaerated feedwater and the extracted water to and from the steam generator until the steam generator returns to service in a firing mode of operation.

* * * * *